United States Patent [19]

Puhak

[11] Patent Number: 4,506,188

[45] Date of Patent: Mar. 19, 1985

[54] LAMINATED METALLIC MEANS FOR DAMPENING INTERNAL CRT VIBRATIONS

[75] Inventor: Peter G. Puhak, Seneca Falls, N.Y.

[73] Assignee: North American Philips Consumer Electronics Corp., New York, N.Y.

[21] Appl. No.: 444,107

[22] Filed: Nov. 24, 1982

[51] Int. Cl.[3] ..... H01J 29/07

[52] U.S. Cl. ..... 313/405; 313/407; 313/269

[58] Field of Search ..... 313/404, 405, 407, 402, 313/408, 406, 269

[56] References Cited

U.S. PATENT DOCUMENTS 3,823,336 7/1974 Nakamura et al. ..... 313/405

4,318,025 3/1982 Penird et al. ..... 313/404

*Primary Examiner*—David K. Moore

*Assistant Examiner*—K. Wieder

*Attorney, Agent, or Firm*—Thomas A. Briody; Jack Oisher; John C. Fox

[57] ABSTRACT

The invention relates to improved means for dampening structural vibrations physically induced in an operating color cathode ray tube by an external audio source. The dampener is formed of a resilient laminated bimetallic material evidencing spring-like characteristics, being configurated to have at least one concave bend therein. At least one such dampener is located to bridge the spacing between the panel sidewall and the sidewall of the apertured member frame. One member of the laminated dampener has resilient spring-like qualities while another member is of a softer material, the dampener being oriented to have the softer material make contact with the panel sidewall to augment the vibration deadening effects of the dampener.

5 Claims, 6 Drawing Figures

LAMINATED METALLIC MEANS FOR DAMPENING INTERNAL CRT VIBRATIONS

BACKGROUND OF THE INVENTION

1. Field of the Invention

The invention relates to color cathode ray tubes having an apertured member within the display panel and more particularly to improved internally positioned means for dampening vibrations of the apertured member.

2. Description of the Prior Art

The progressive advancement of color television receiver art is manifest in both the video and audio portions of the equipment. Recent improvements in the sound circuitry have incorporated stereo and wide range audio responses into the receiver. While such improvements achieve enhanced realism in audio reproduction, some related video problems have occurred in certain receiver cabinet environments. For example, there are instances in which low frequency vibrations emanating from the bass speakers are physically transferred through elements of the cabinet structure to the color cathode ray tube component. Such sound-induced vibrations can cause deleterious movement of the shadow mask-frame assembly suspensionally-mounted on the sidewall of the display panel, in turn causing misregistration of the electron beams impinging on the patterned display screen, and degradation of picture quality.

To counteract these vibration-induced "microphonics", a plurality of suppression or dampening means have been added to the shadow mask frame assembly of the CRT as disclosed by Carl W. Penird and Richard A. Tamburrino in U.S. Pat. No. 4,318,025. Such suppressors are formed of spring-like material and attached to the ledge of the mask framing member and extended therefrom in a manner to make contact with the adjacent sidewall of the display panel, thereby effecting dampening of the audio-induced vibrations of the shadow mask-frame assembly. In some instances, the extensive bent-leg formations of the suppressors allows a degree of reverberation which detracts from the intended dampening effect of the suppressors. Such is especially noticeable when the extra mass of an internal shielding member is attached to the frame portion of the mask-frame assembly.

SUMMARY OF THE INVENTION

The invention pertains to an improvement in the apertured member-display panel assembly of a color cathode ray tube wherein vibration dampening means are incorporated therein to minimize audio-induced vibrations of the tube structure in the television receiver. The apertured member, referred to herein, may be either a conventional shadow mask or a multi-opening grid like member supported by a framing member, such mask-frame assembly or grid-frame assembly being spatially and suspensionally supported within the display panel portion of the tube.

The improvement is comprised of at least one resilient vibration dampening component formed of a laminated bi-metallic material, oriented in a manner to compressively bridge the spacing between the display panel sidewall and the sidewall of the apertured component frame member. The dampener has a seating portion adapted for affixation to the sidewall of the framing member. Integral with the seating portion is an outwardly extending resilient portion shaped to make positive contact with the adjacent panel sidewall, and having a terminal end directed away from the panel display area. The seating and extending portions are joined by an intermediate concave transitional region to effect a one-piece structure of "U" shaped cross-section.

The dampener is a laminate of at least two metallic materials, an "alpha" material of a relatively mechanically soft composition and a "beta" material of a relatively hard spring-like resilient composition. The structure of the dampener is such that the alpha layer is oriented to make contact with the panel sidewall. To minimize any abrasion of the conductive coating on the panel sidewall, at least one smooth surfaced protuberance is formed in the terminal region of the outwardly extending element to make positive contact with the panel sidewall.

In another embodiment of the invention, the structure of the dampener is modified to include an intermediate portion between the seating and outwardly extending portions, such being integrated therewith by concave transitional regions at either end thereof to form a dampener of "S" shaped cross-section.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Figure 1:
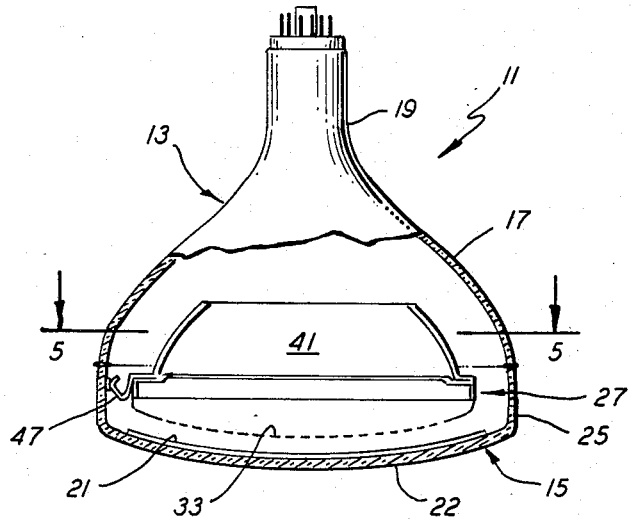
FIG. 1 is an elevational view, in partial cross-section, of a color CRT showing orientation of the invention therein.
Figure 2:
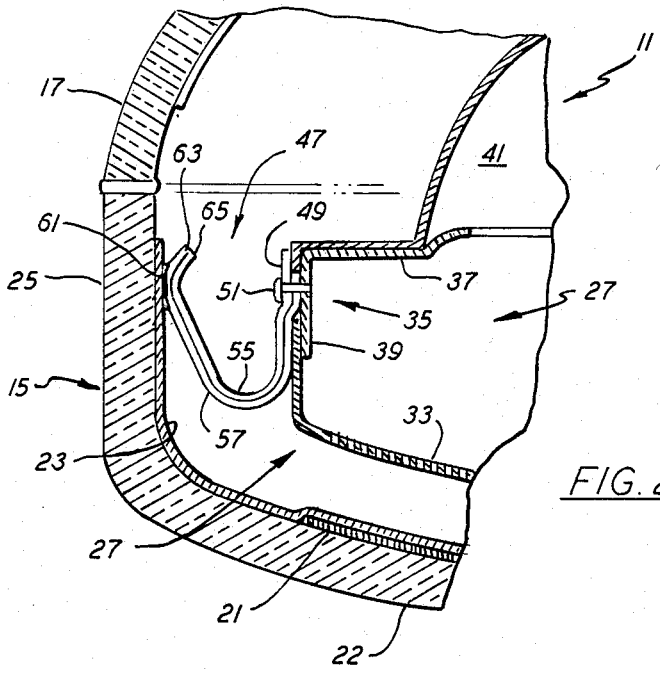
FIG. 2 is an enlarged cross-section illustrating the relationship of the invention to the apertured portion framing member and the panel sidewall.
Figure 5:
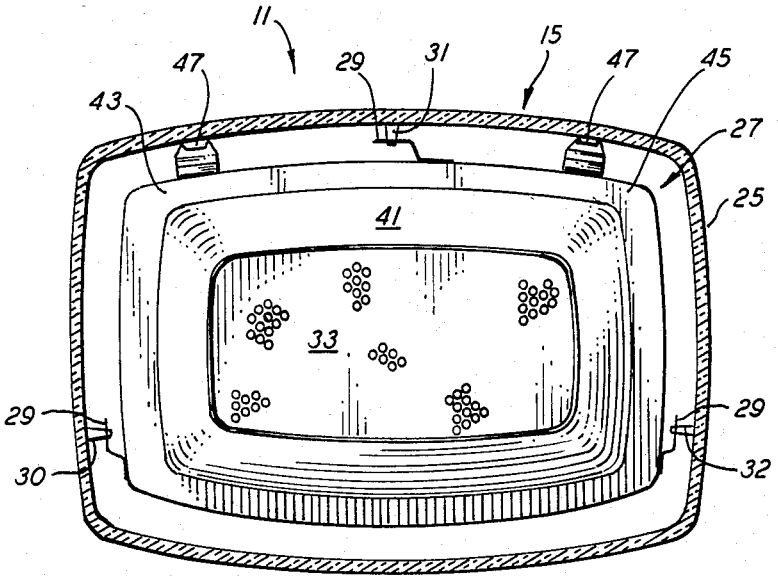
FIG. 5 is a plan view taken along the plane 5—5 of FIG. 1 showing exemplary positioning of the dampeners in the apertured member-panel assembly.

With reference to the drawings, there is shown in FIGS. 1, 2 and 5 an exemplary color cathode ray tube 11, having an envelope enclosure 13 comprised of an integration of panel 15, funnel 17 and neck 19 portions. Adhered to the interior surface of the display panel 15 is a discretely patterned cathodoluminescent screen 21 formed of a multitude of repetitive areas of color-emitting phosphor materials providing a display area 22. A thin metallized conductive film 23, such as aluminum, is usually applied over the surface of the screen and a portion of the sidewall 25 of the panel portion 15.

A multi-apertured member 27, such as a shadow mask or a grid-type structure, having discretely shaped openings therein, is spatially related to the patterned screen 21, such being predeterminately positioned or suspended within the panel 15 by a plurality of locating springs 29 which are mated with exemplary cooperating stud-like supporting members 30, 31 and 32 embedded in the panel sidewall 25 in spaced-apart orientation. As shown, the apertured member 27 is comprised of the multi-opening portion 33 peripherally affixed to a rigid perimetric framing member 35 having a substantially instanding ledge 37 and a related sidewall portion 39, such being spatially related to the panel sidewall 25 in a substantially parallel manner. The assembly of the apertured member 27 and the panel 15 constitutes what is conventionally referred to as an apertured member-panel assembly, such being attached as a unit to the funnel portion 17 during tube manufacturing.

A number of tubes utilize an inner shield or internal magnetic shielding element 41 which is seated on and securely attached to the rear portion of the framing member 35. This structure, formed of thin metal, is shaped to evidence a continuous contoured bowl-like sidewall enclosure having front and rear openings formed therein. The presence of this shielding element increases the mass of the apertured member, and when such is set in motion by externally effected vibrations, an unacceptable vibration pattern is produced having a high amplitude and long decay time.

In FIG. 5, an exemplary three-point suspension of the apertured member 27 is shown. When the tube is subjected to vibrations, supporting studs 30 and 32, being substantially aligned on opposite sides of the panel 15, form pivot points for the associated apertured member positioning springs 29. These in conjunction with the substantially 12 o'clock supporting stud 31 and mating spring 29 permit a twisting movement which is accentuated in substantially the opposed corner regions 43 and 45 of the apertured member assembly. While the degree of movement may be relatively small, the effects of periodic movement or vibration are dramatically evidenced on the display screen of the operating tube.

Figure 3:
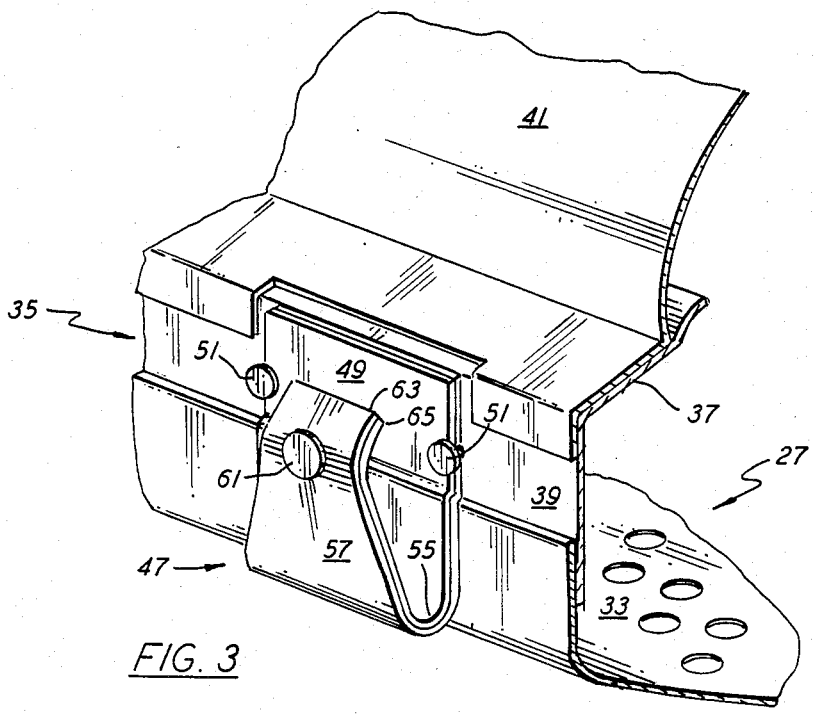
FIG. 3 is a perspective view showing the dampener attached to the side of the apertured portion framing member.
Figure 4:
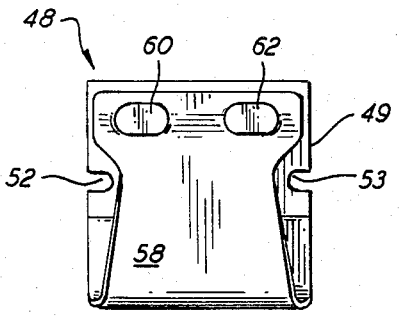
FIG. 4 is a frontal view of a dampener embodiment wherein the outwardly extending element evidences greater width than that shown in FIG. 3.

The invention is directed to improved means for dampening these deleterious vibrations which are physically transmitted to the tube. This improved means is in the form of at least one resilient dampener 47 formed of laminated bimetallic material and oriented to compressively bridge the spacing between the panel sidewall 25 and the sidewall 39 of the apertured member frame 35. The dampener 47 is constructed to have a seating portion 49 adapted for affixation to the side wall 39 of the frame 35. One means of attachment is shown in FIGS. 2, 3, and 4 wherein a plurality of clips, darts or rivets 51 are inserted through cut-out openings 52 and 53 in the seating portion 49 which mate with aligned holes in the side wall 39 of the frame. Integrally joined with the seating portion 49, at a concave bend or transition region 55, is an outwardly extending resilient portion 57 which is formed to make contact with the panel sidewall 25. The terminal end 59 of this portion, which is directed away from the display area 22, may have at least one smooth surfaced protuberance 61 formed therein to make non-abrasive contact with the panel sidewall 25.

In the dampener modification 48 illustrated in FIG. 4, the outwardly extending portion 58 exhibits a greater width than the portion 57 in FIG. 3 and embodies a plurality of contacting protuberances 60 and 62.

The dampener, which evidences resilience, is a lamination of at least two different superposed metallic materials of alpha 63 and beta 65 designations. The beta material 65, of a composition such as a stainless steel, provides a spring-like resilience to the dampener, while the associated alpha material 63 is of a softer, e.g., non-ferrous, composition providing additional deadening or dampening characteristics to the structure. Examples of suitable alpha materials are aluminum, cadmium, nickel, zinc and their alloys. In the embodiment shown in FIGS. 2, 3, and 4, the softer alpha laminate material 63 is oriented in the dampener structure in a manner that it makes both compressive contact with the panel sidewall 25 and seating contact with side wall 39 of the framing member 35. Such material orientation effectively utilizes the vibration deadening characteristics of the softer alpha component, while allowing the harder spring-like material to maintain firm contact with the panel sidewall and permit the essential movement of the apertured member locating springs 29 during tube warmup when the apertures are brought into desired alignment with the pattern elements of the screen.

Figure 6:
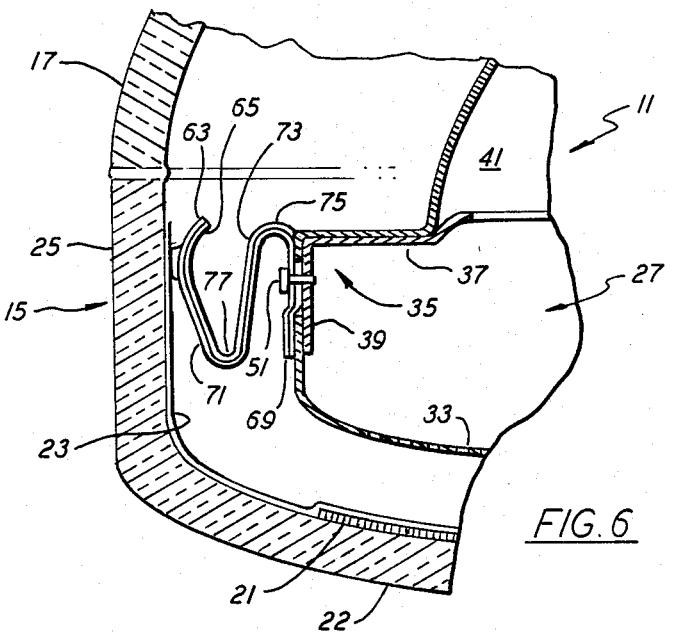
FIG. 6 is a cross-sectional illustration of another embodiment of the invention.

Another embodiment of the invention is illustrated in FIG. 6. In this modification, the seating portion 69 and the outwardly extending portion 71 have an intermediate portion 73 therebetween; such being integrated with the associated elements by concave transitional bends or regions 75 and 77 at either end thereof. The softer alpha laminate material 63 is oriented to make contact with the panel sidewall 25.

It is to be noted that all embodiments of the invention utilize relatively broad seating portions to maximize contact with the side wall of the framing member. This is an important consideration as it effects maximum support for the contiguous concave transitional region in the structure and improves the vibration deadening characteristics thereof.

As many of the improved bimetal dampeners may be employed in the tube as are considered necessary to achieve the desired results. For example, in FIG. 5, two of the dampeners 47 are utilized near the corner regions 43 and 45 of the apertured member 27. Dampeners mounted at such locations counteract the twisting vibrations previously mentioned herein, thereby minimizing or eliminating the undesired optical distortions generated by audio induced vibrations physically introduced into the tube structure.

While there have been shown and described what are at present considered to be the preferred embodiments of the invention, it will be apparent to those skilled in the art that various changes and modifications may be made therein without departing from the scope of the invention as defined in the appended claims.

I claim:

1. An improvement in the apertured member-panel assembly of a color cathode ray tube in which the panel has a frontal display area and a surrounding sidewall; and in which the apertured member of said assembly is spatially and moveably supported within said panel by spring means, said apertured member comprising a multi-apertured portion peripherally affixed to a perimetric framing member, the framing member having a side wall portion spatially related to said panel sidewall in a substantially parallel manner, and an integral ledge portion instanding therefrom, said improvement comprising:

at least one resilient vibration dampener formed of resilient laminated bimetallic material and oriented to compressively bridge the spacing between said panel sidewall and the side wall of said apertured member frame, said dampener having a seating portion adapted for affixation to the side wall of said frame and an outwardly extending resilient portion formed to make contact with said panel sidewall, said outwardly extending portion having a terminal end directed away from said display area, said portions being integrated at a concave transition region intermediate therebetween, said dampener material being a laminate of at least two different alpha and beta materials, said alpha material of a softer composition than that of said beta material, the dampener being oriented so that said alpha material makes contact with said panel side wall.

2. The improved apertured member-panel assembly of a color cathode ray tube according to claim 1 wherein said alpha material is a non-ferrous metal.

3. The improved apertured member-panel assembly of a color cathode ray tube according to claim 1 wherein said outwardly extending portion of the dampener has at least one smooth surface protuberance formed in the terminal region thereof to make contact with said panel sidewall.

4. The improved apertured member-panel assembly of a color cathode ray tube according to claim 1 wherein said apertured member-panel assembly has an internal shielding member attached to said framing member, said shielding member being seated on the instanding ledge portion thereof.

5. The improved apertured member-panel assembly of a color cathode ray tube according to claim 1 wherein the seating and outwardly extending portions of said dampener have an intermediate portion therebetween, said intermediate portion being integrated therewith by concave transitional regions at either end thereof.

* * * * *